United States Patent [19]

Kulbersh

[11] Patent Number: 4,729,485

[45] Date of Patent: Mar. 8, 1988

[54] FENCE OR PARTITION FOR A SHELF

[75] Inventor: Irwin Kulbersh, Skokie, Ill.

[73] Assignee: Amco Corporation, Chicago, Ill.

[21] Appl. No.: 892,241

[22] Filed: Jul. 31, 1986

[51] Int. Cl.[4] ..... A47F 5/00

[52] U.S. Cl. ..... 211/184; 211/181

[58] Field of Search ..... 211/184, 181, 134; 312/140.4

[56] References Cited

U.S. PATENT DOCUMENTS

| | | | |
|---|---|---|---|
| 2,933,195 | 4/1960 | Radek | 211/184 X |
| 3,358,956 | 12/1967 | Thornton | 211/184 X |
| 3,608,741 | 9/1971 | Schray | 211/184 |
| 3,637,085 | 1/1972 | Ball | 211/153 |
| 3,698,568 | 10/1972 | Armstrong | 211/184 |
| 4,190,167 | 2/1980 | Wells et al. | 211/184 |
| 4,331,243 | 5/1982 | Doll | 211/184 X |

*Primary Examiner*—Ramon S. Britts
*Assistant Examiner*—Blair M. Johnson
*Attorney, Agent, or Firm*—Laff, Whitesel, Conte & Saret

[57] ABSTRACT

A fence or partition for a flat shelf is provided that can be installed at different locations on the shelf and can be made in various sizes. The partition comprises a rectangular frame formed from a bent rod with at least one post attached to the frame perpendicular to the length of the frame. The post extends below the frame and is removably secured in a step clip. The step clip is designed to removably fit on the shelf.

3 Claims, 5 Drawing Figures

FENCE OR PARTITION FOR A SHELF

FIELD OF THE INVENTION

The present invention relates to a fence or partition for a shelving assembly. More particularly, the present invention relates to a rigid vertical partition that can be made in various lengths and installed at many different locations on a flat shelf. The design of the partition allows for fast and easy manual installation onto the shelf.

BACKGROUND OF THE INVENTION

Shelving systems comprising a plurality of flat shelves supported by several post members are known in the art. Such systems are often made of metal and are adjustable to vary shelf heights. Individual shelves can be secured to the posts at varying heights to accommodate and support items of various sizes, thus enabling great flexibility as product designs and storage requirements change. An adjustable shelving system has been described in U.S. Pat. Nos. 3,424,111 and 3,523,508.

Vertical partitions or fences that extend from one corner post to another corner post on the perimeter of the wire shelf are also known in the art. Such fences are used to prevent the items supported on the shelf from rolling or otherwise falling off the shelf. There are various methods of installing these fences on the shelf assembly. One method is the use of nuts and screws. Another method is the use of bifurcated or split ends on the fence adapted to slip partially around the corner posts of the shelf assembly.

Vertical partitions may also be used to divide an individual shelf into two or more compartments or sections. Such a partition would be used if it is desired to segregate different types of items stored on a shelf. Partitioning a shelf may be required when several different types of items are stored on the same shelf and it is necessary to keep them segregated for inventory or handling purposes. Partitions that extend across the interior of the shelf from one side to the other side to divide the shelf into sections and are attached to the perimeter of the shelf are known in the art. As with the perimeter fence, one method of attaching the partition to the shelf perimeter is by means of a bifurcated or split end that slips over the member or frame that forms the shelf perimeter.

The use of vertical fences or partitions that extend from one corner post to another corner post or that extend across the entire width or length of the shelf from one side to the other side have several limitations. One limitation, for example, is that since shelves come in several different dimensions, fences and partitions of several different sizes are needed to accommodate different sized shelves. Another limitation of the fences and partitions known in the art is that because they are designed to attach to the corner posts or the shelf's perimeter, they extend accross or along the entire width or length of the shelf. Often, it is desired to fence or partition a section of a shelf that is less than the entire length or width. This cannot be done with the fences and partitions known in the art.

Another limitation is that the fences and partitions known in the art cannot be used interchangeably. That is, a fence designed to attach to the corner posts cannot be used as a partition because the fence cannot be attached to the perimeter of the shelf, and vice-versa.

Accordingly, it is an object of the present invention to provide a member that can be used interchangeably as a fence or partition on shelves of various sizes.

Another object of the present invention is to provide a fence or partition that can be easily installed by hand.

A further object of the present invention is to provide a fence or partition that can be easily installed at different locations on a shelf to provide flexibility in designing a shelf storage system to accommodate products of different sizes and shapes and to meet different storage requirements.

Yet another object of the present invention is to provide a fence or partition that is economical and efficient to manufacture and can be securely connected to a shelf so that it will not be inadvertently pried loose.

In the preferred embodiment of the invention, a rectangular shaped frame formed from an elongated metal rod is provided. At least three posts are attached to the frame perpendicular to the length of the frame. At least two of the posts extend downwardly below the frame for insertion into a pair of step clips. The step clips are shaped so that they can be easily slipped over a portion of the shelf to securely hold the fence in place. The downwardly extending posts fit through a pair of holes in the step clips and a push nut is secured to the bottom of each post to hold the posts in the step clips.

BRIEF DESCRIPTION OF THE DRAWINGS

In the drawings, which constitute a part of this specification, the preferred embodiment demonstrating the various objectives and features of the invention is set forth wherein.

DETAILED DESCRIPTION OF THE INVENTION

Figure 1:
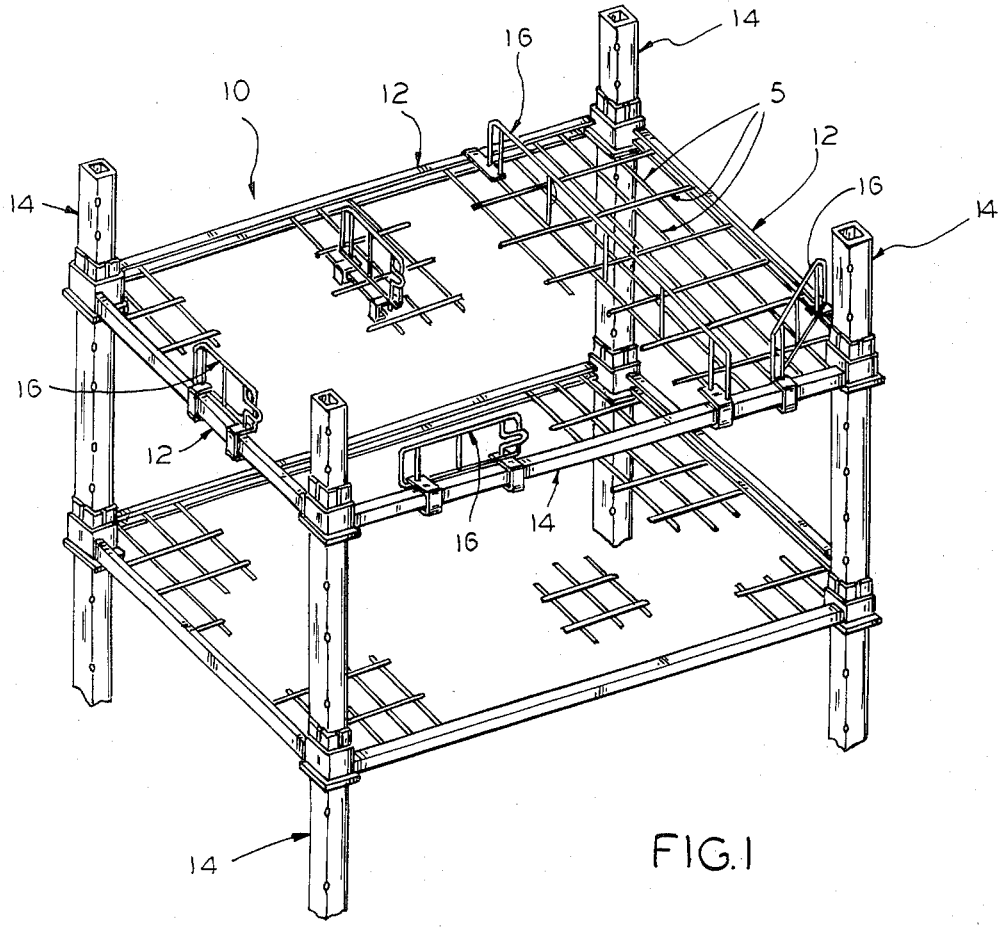
FIG. 1 is an isometric view of a wire shelf assembly showing various arrangements of the invention secured to a wire mat shelf.

Referring to FIG. 1, shelf 10, which comprises wire mat 5 and channel 12, is supported by four corner posts 14. FIG. 1 illustrates various arrangements of vertical fences and partitions on shelf 10.

Figure 2:
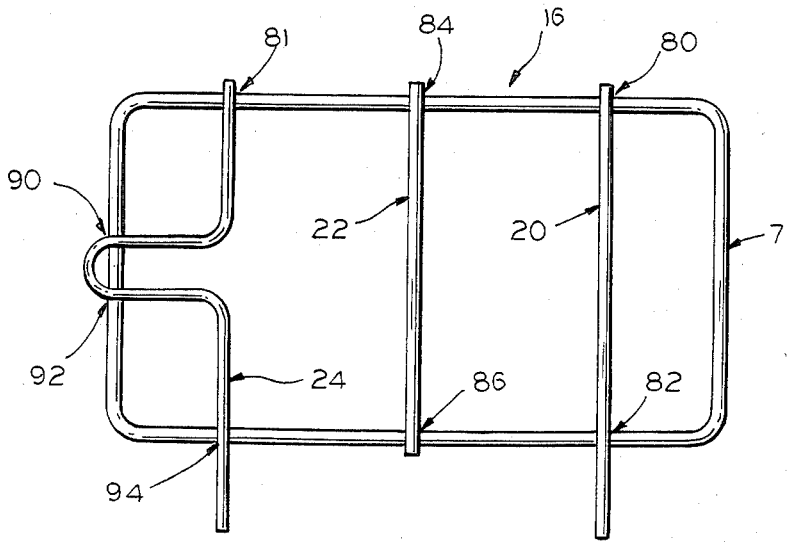
FIG. 2 is an elevation view of the fence that comprises part of the invention.

Referring to FIG. 2, fence or partition 16 (hereinafter collectively referred to as "fence") comprises a metal elongated rod member 7, bent into a rectangular shape to form a frame. Posts 20, 22 and 24 are securely attached to frame 7, such as by welding in the case of a wire fence, at points 80, 82, 84, 86, and 88. Post 24 is not attached at points 90, 92 and 94 allowing the post to deflect slightly if necessary, as explained below. Posts 20 and 24 extend downwardly below frame 7 for insertion into step clip 18 (not shown in FIG. 2). Fence 16 may be constructed of any suitable material such as metal or plastic.

Figure 3:
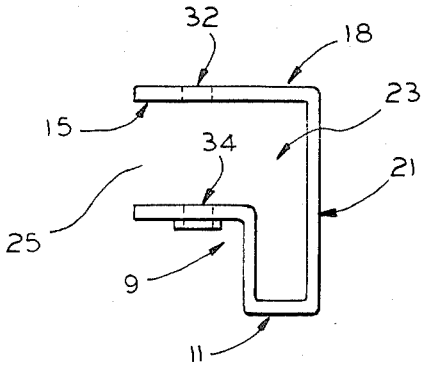
FIG. 3 is a side view of the step clip that comprises part of the invention.
Figure 4:
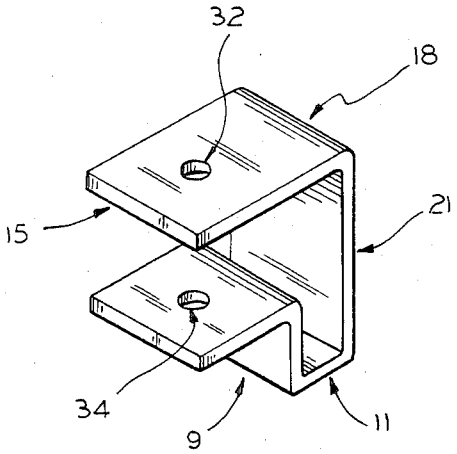
FIG. 4 is an isometric view of the step clip.

Fence 16 is attached to the shelf 10 by means of step clip 18. As shown in FIGS. 3 and 4, step clip 18 comprises a generally C-shaped member with a step 9 formed in lower tongue 11. Upper tongue 15 is provided with hole 32 and lower tongue 11 is provided with hole 34 to receive either post 20 or 24. Hole 34 is extruded to produce a funnel shape to add rigidity to the post when it is inserted through hole 34.

Tongues 11 and 15 together with backwall 21 of clip 18 form interior space 23 with opening 25. Interior space 23 is shaped to fit around the perimeter portion of shelf 10, i.e. channel 12, or around rods 30 of the interior wire mat 5. By aligning opening 25 at a slight angle with the channel 12 or rods 30 of wire mat 5, step clip 18 can be slipped over the channel or mat.

As shown in FIG. 1, fence 16 can be secured to either channel 12 on the perimeter of shelf 10 or to wire mat 5 in the interior of the shelf. To illustrate the manner in which fence 16 is attached to either channel 12 or wire mat 5, fence 16 is shown in an arrangement in FIG. 5 where it is attached to both channel 12 and wire mat 5. In this instance, the fence would serve to partition an interior section of shelf 10. To secure fence 16 to shelf 10, step clip 18 is placed or slipped over channel 12 and wire mat rods 30. After the step clips 18 are in place, posts 20 and 24 are each inserted through holes 32 and 34. Push nut or other retaining device 36 is then securely placed on the bottom of posts 20 and 24 to lock the posts in place in clips 18.

Figure 5:
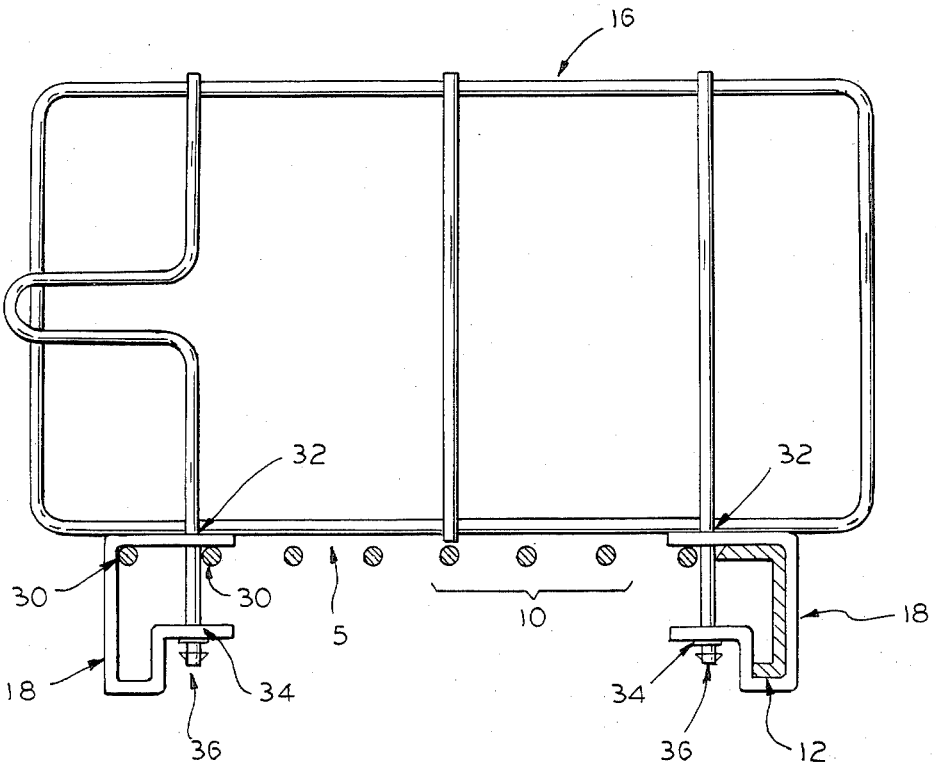
FIG. 5 is an elevation view of one arrangement of the invention secured to a wire shelf.

As can be seen in FIG. 5, when the posts 20 and 24 are secured in step clip 18, the posts and step clip securely hold channel 12 or rods 30 between them. Fence 16 is thus securely held in place.

If it is desired to remove fence 16 from shelf 10, push nuts 36 are dislodged from the ends of posts 20 and 24 and the posts are withdrawn from step clips 18. The step clips can then be removed from shelf 10.

In order to accommodate irregularities in the spacing between wire mat rods 30, which may result from manufacturing tolerances, post 24 can be deflected slightly so that step clip 18 can be placed between rods 30.

As can now be appreciated, fence 16 can be removably secured to many different locations and in different orientations on shelf 10 to accommodate different storage requirements. For example, several fences can be secured along the perimeter on one side of the shelf to completely fence in that side. Or, alternatively, only a portion of the perimeter can be fenced. Likewise, the interior of the shelf can be sectioned off into numerous compartments that can vary widely in shapes and sizes depending on the storage needs. Furthermore, fence 16 can be made in a variety of sizes such as six, nine or more inches in length and height. This variation in size also contributes to the adaptability of the invention to many different situations.

Longer fences may be provided with more than three posts (as shown in the figures) to support frame 7 and for securing the fence to the shelf. For example, a thirty-six inch fence may be provided with nine posts, three or four of which extend downwardly below frame 7 for insertion into the step clips and attachment to the shelves.

The present invention thus provides a method to partition or fence a storage shelf that can be adapted to innumerable situations, yet it is easy and economical to use.

Those who are skilled in the art will readily perceive how to modify the system. Therefore, the appended claims are to be construed to cover all equivalent structures which fall within the true scope and spirit of the invention.

The claimed invention is:

1. A fence for partitioning or enclosing a wire shelf comprising a rectangular upright member having a frame formed by an elongated rod bent into a rectangular shape and at least one post attached to and extending below said frame and oriented perpendicular to the length of the frame, at least one clip adapted to be removably secured to said wire shelf and to receive said upright member, said clip having a first upper tongue, a back wall extending downwardly from and perpendicular to said first tongue, a second lower tongue extending from said back wall below said first tongue to form with said first tongue and backwall an interior space which opens external of said clip, said space adapted to receive a portion of said shelf for placement of said clip on said shelf, and the tongues on said clip are each provided with a hole to receive said post.

2. The fence of claim 1 wherein the portion of the lower tongue around the perimeter of said hole is extruded.

3. The fence of claim 1 including at least one push nut adapted to be removably secured to the bottom of said post after it is inserted through said holes on the clip.

* * * * *